US007134986B2

(12) United States Patent
Tiberio

(10) Patent No.: US 7,134,986 B2
(45) Date of Patent: Nov. 14, 2006

(54) FACIAL MUSCLES EXERCISING METHOD AND APPARATUS

(76) Inventor: Albert Tiberio, 226 Melrose Dr., New Stanton, PA (US) 15672

( * ) Notice: Subject to any disclaimer, the term of this patent is extended or adjusted under 35 U.S.C. 154(b) by 383 days.

(21) Appl. No.: 10/370,502

(22) Filed: Feb. 24, 2003

(65) Prior Publication Data

US 2004/0166993 A1 Aug. 26, 2004

(51) Int. Cl.
*A63B 23/03* (2006.01)
*A63B 21/055* (2006.01)
*A63B 21/06* (2006.01)

(52) U.S. Cl. ..... 482/11; 482/93; 482/97; 482/124; 601/38

(58) Field of Classification Search ..... 482/11, 482/91–93, 10, 97, 121, 122, 124, 126–128, 482/105, 139, 907; 601/38; 600/242, 238, 600/237

See application file for complete search history.

(56) References Cited

U.S. PATENT DOCUMENTS

| | | | | |
|---|---|---|---|---|
| 1,363,534 | A | 12/1920 | Rogers | |
| 3,813,096 | A | 5/1974 | Welch | |
| 4,671,260 | A | 6/1987 | Buckner | |
| 4,744,556 | A * | 5/1988 | Shaffer | 482/11 |
| 5,246,413 | A * | 9/1993 | Koblick | 482/126 |
| 5,577,983 | A | 11/1996 | Fraser | |
| 5,690,596 | A * | 11/1997 | Parker | 482/126 |
| 5,919,116 | A | 7/1999 | Edell | |
| 6,406,405 | B1 * | 6/2002 | Chu | 482/11 |
| 6,923,761 | B1 * | 8/2005 | Dorfman | 600/237 |
| 2003/0073542 | A1 * | 4/2003 | Patton | 482/10 |

FOREIGN PATENT DOCUMENTS

DE 3433356 A1 * 3/1986

* cited by examiner

*Primary Examiner*—Jerome Donnelly
*Assistant Examiner*—Victor K. Hwang
(74) *Attorney, Agent, or Firm*—Marvin S. Towsend

(57) ABSTRACT

A facial muscles exercising apparatus includes horizontally oriented dynamic resistance means for providing dynamic resistance to facial muscles that are exercised in a horizontal direction, vertically oriented dynamic resistance means for providing dynamic resistance to facial muscles that are exercised in a vertical direction, and vertically oriented isometric resistance means for providing isometric resistance to facial muscles that are exercised in a vertical direction. The facial muscles can be oriented in a horizontal orientation and in a vertical orientation. Also, in accordance with the invention, a method of exercising facial muscles is provided which includes the steps of having the facial muscles overcome dynamic resistance in a horizontal orientation, having the facial muscles overcome dynamic resistance in a vertical direction, and having the facial muscles encounter isometric resistance in a vertical direction. The facial muscles can be oriented in a horizontal orientation and in a vertical orientation.

13 Claims, 8 Drawing Sheets

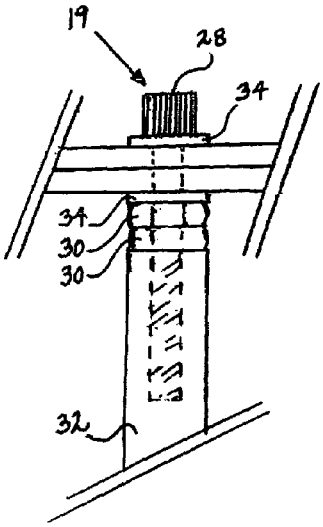
FIG. 3
FIG. 6
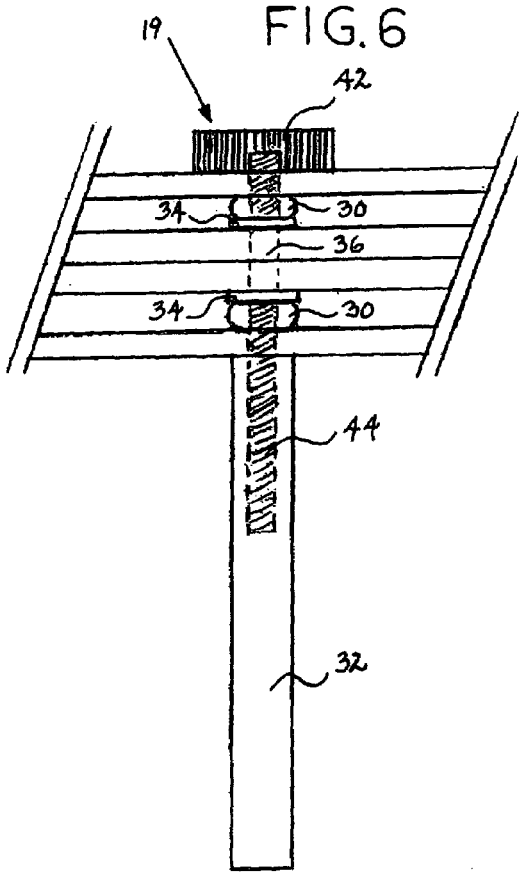
FIG. 5
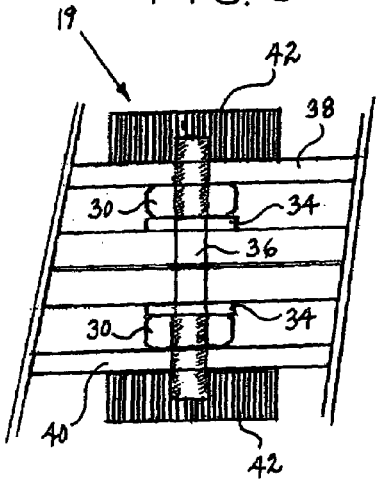

FIG. 12
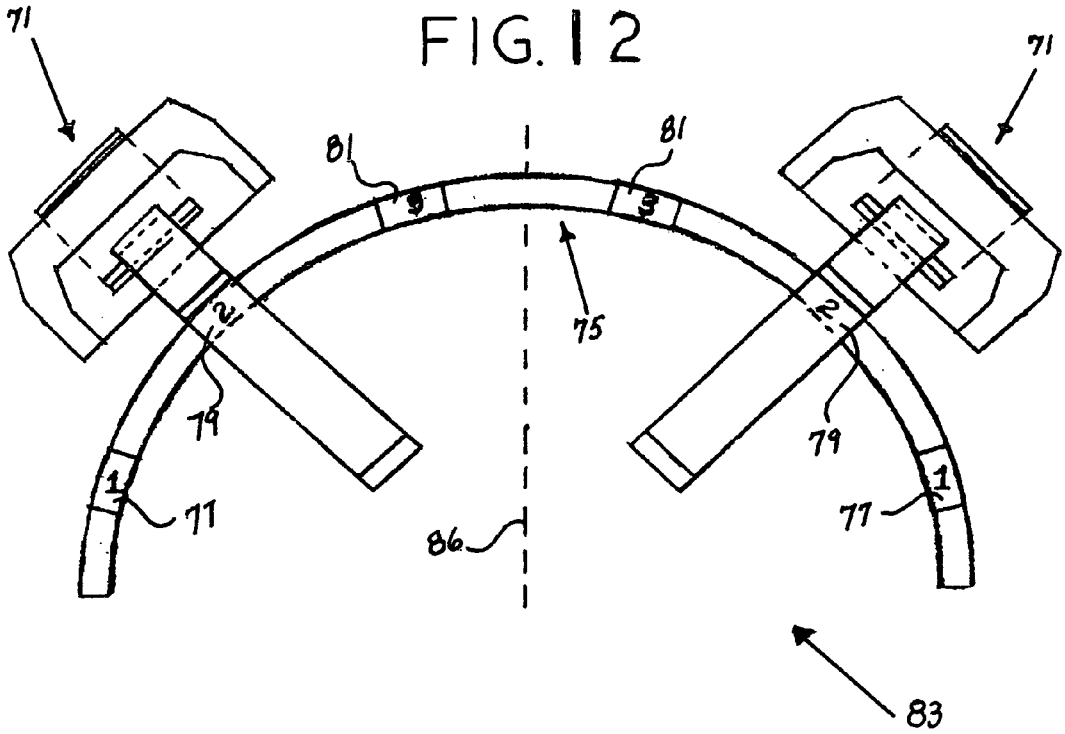
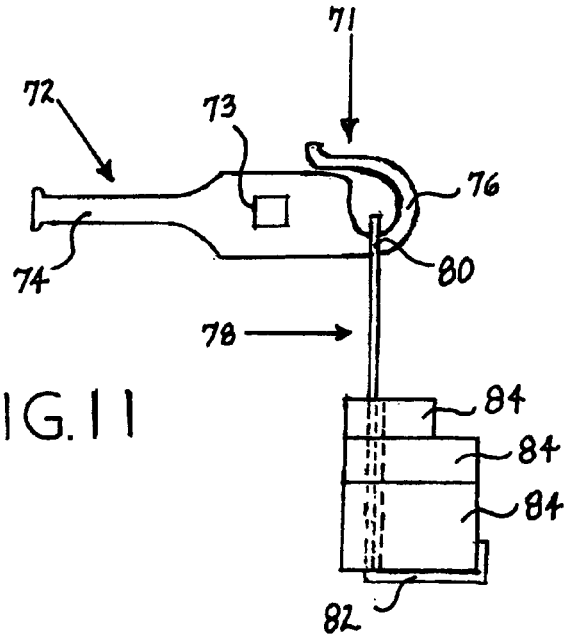
FIG. 11

FACIAL MUSCLES EXERCISING METHOD AND APPARATUS

BACKGROUND OF THE INVENTION

1. Field of the Invention

The present invention relates generally to exercising devices, and, more particularly, to exercising devices especially adapted for exercising facial muscles.

2. Description of the Prior Art

Throughout the years, a number of innovations have been developed relating to exercising facial muscles, and the following U.S. patents are representative of some of those innovations:

U.S. Pat. No. 1,363,534 of Rogers

U.S. Pat. No. 3,813,096 of Welch

U.S. Pat. No. 4,671,260 of Buckner

U.S. Pat. No. 5,577,983 of Fraser

U.S. Pat. No. 5,919,116 of Edell

Rogers (U.S. Pat. No. 1,363,534) discloses an apparatus for exercising muscles of the face. This apparatus includes a first arm, a second arm, and a pivot between the two arms. Mouth pieces are located at proximal ends of the arms, and an elastic band is located at the distal ends of the arms. A handle is also employed and is located at the pivot. This patent discloses the exercise of facial muscles only in a horizontal direction. There is no disclosure of exercising facial muscles in a vertical direction. For more complete exercise of facial muscles, it would be desirable if a facial muscle exercising apparatus were provided that also exercises facial muscles in a vertical direction.

Welch (U.S. Pat. No. 3,813,096) discloses an apparatus for exercising muscles of the face which includes a first arm and a second arm, each of which is independently pivoted on a circular indentation 20 or 21 of support body 11. Proximal ends of the arms are placed in a user's mouth, and an elastic retaining band 13 is placed between distal ends of the arms. A handle 10 is also provided. Resistance to muscle exercise is provided by an elastic band which sits upon lever portions 27. Each arm that is placed in the user's mouth is supported by a support body 11. However, the respective arms are not connected directly together. For purposes of simplicity, it would be desirable if muscle exercising arms were connected directly together.

Buckner (U.S. Pat. No. 4,671,260) discloses an apparatus for exercising muscles of the face. It includes two shanks 18 and 22 which have ends upon which mouth pieces are installed. An elastic band 26 is stretched as the user moves the mouth pieces towards each other. When the mouth-received portions move back and force during exercise of the facial muscles, the two shanks 18 and 22 are translated longitudinally with respect to each other. Moreover, the two shanks are not connected directly with each other. Instead, the elastic band serves to connect the two shanks together. Since the two shanks are not connected directly with each other, they may be subject to separation from each other and misalignment if inadvertent force is applied normal to the direction of translation motion. In this respect, it would be desirable if a device for exercising facial muscles were provided in which exercising arms are connected directly together and in which the arms do not undergo translation motion as the facial muscles are being exercised.

Fraser (U.S. Pat. No. 5,577,983) discloses an apparatus for exercising muscles of the face. A Y-shaped structure has a handle and two arms. Each arm has a separate pivot for a mouth piece. For purposes of simplicity, it would be desirable if a device for exercising facial muscles were provided in which two exercising arms were connected together with a single pivot.

Edell (U.S. Pat. No. 5,919,116) discloses an apparatus for exercising muscles of the face. It includes two shanks which have ends upon which mouth pieces are installed. Each shank is associated with an end piece that receives an end of one shank and that serves as a sliding bearing for the other shank. Either springs or an elastic band provides resistance between the mouth pieces. The two arms undergo a translation motion as the facial muscles are exercised. The desirability of non-translational motion of exercising arms has been stated above. Moreover, with this device, the exercising arms are not securely connected to each other. If an elastic band is removed, the arms can be easily separated. In this respect, it would be desirable if a device for exercising facial muscles were provided in which the exercising arms were securely connected together, even in the absence of an elastic band.

Still other features would be desirable in a facial muscles exercising method and apparatus. For example, for purposes of aesthetics and convenience in storage and transport, it would be desirable if a device for exercising facial muscles were provided that is substantially contained in a housing, from which only mouth-engaging members can stick out for engaging the mouth of a user. Also, it would be desirable if a device for exercising facial muscles were provided which included a set of springs or the like that can be used for gradually increasing resistance to muscle exercising and the muscles gradually increase in strength.

Also, it would be desirable if a device for exercising facial muscles were provided which increased muscle strength and mass due to the capability of the device to provide the facial muscles with a controlled scale of graduated resistance increments.

In addition, it would be desirable if a device for exercising facial muscles were provided which would offer a stretching of the facial muscles prior to each active contraction thereby increasing venous and lymphatic flow to the facial area and improving skin and muscle tissue tone.

Also, it would be desirable if a device for exercising facial muscles were provided which permits following a varied strengthening and conditioning program using horizontal and vertical dynamic and isometric contractions, as well as, spring and weight modes of resistance.

Further, it would be desirable if a device for exercising facial muscles were provided which facilitates a user to feel a sense of personal accomplishment as the user is taking an active role in his or her facial muscle enhancement program, which is user measurable and trackable.

Thus, while the foregoing body of prior art indicates it to be well known to use devices to exercise facial muscles, the prior art described above does not teach or suggest a facial muscles exercising method and apparatus which has the following combination of desirable features: (1) permits increased muscle strength and mass due to the capability of the apparatus to provide the facial muscles with a controlled scale of graduated resistance increments; (2) provides a stretching of the facial muscles prior to each active contraction, which promotes increased venous and lymphatic flow to the facial area thereby improving skin and muscle tissue tone; (3) permits carrying out a varied strengthening and conditioning program using horizontal and vertical dynamic and isometric contractions, as well as, spring and weight modes of resistance; (4) facilitates a user to have a sense of personal accomplishment as the user is taking an active role in his or her facial muscle enhancement program, which is user measurable and trackable; (5) exercises facial muscles in a vertical direction; (6) provides for graduated increases in resistance to build muscle strength; (7) provides muscle exercising arms which are connected directly together; (8) provides exercising arms that are connected directly together and which the arms do not undergo translation motion as the facial muscles are being exercised; (9) provides two exercising arms which are connected together with a single pivot; (10) provides exercising arms that are securely fixed connected together, even in the absence of an elastic band; and (11) that is substantially contained in a housing, from which only mouth-engaging members can stick out for engaging the mouth of a user.

The foregoing desired characteristics are provided by the unique facial muscles exercising method and apparatus of the present invention as will be made apparent from the following description thereof. Other advantages of the present invention over the prior art also will be rendered evident.

SUMMARY OF THE INVENTION

The facial muscle exercising apparatuses of the invention which are used to carry out the method of the invention are comprised of a number of types of small, portable, hand-held mechanical devices which are used to fully rehabilitate, tone, and develop the facial muscles. The facial muscles involved are primarily those muscles in the orbicularis oris area, which are around the mouth. Secondarily, other facial muscles are involved and extend upward toward the orbicularis oculi area, which are around the eyes. Still other facial muscles are involved which extend downward along the platysma, under the chin and neck.

To achieve the foregoing and other advantages, the present invention, briefly described, provides a facial muscles exercising apparatus which includes horizontally oriented dynamic resistance means for providing dynamic resistance to facial muscles that are exercised in a horizontal direction, vertically oriented dynamic resistance means for providing dynamic resistance to facial muscles that are exercised in a vertical direction, and vertically oriented isometric resistance means for providing isometric resistance to facial muscles that are exercised in a vertical direction. The facial muscles can be oriented in a horizontal orientation and in a vertical orientation.

With one embodiment of the invention, the horizontally oriented dynamic resistance means are in a form of a first exercising device which includes a pair of first exerciser members, each of which includes a mouth-contactor lever arm portion, a fulcrum pivot channel adjacent to the mouth-contactor lever arm portion, and an elastic-member-contactor lever arm portion adjacent to the fulcrum pivot channel. Elastic-member-contactor lever arm portions of the pair of first exerciser members are positioned opposite each other, and the elastic-member-contactor lever arm portions extend substantially in the same direction as the mouth-contactor lever arm portions.

A first pivot is received in the respective fulcrum pivot channels for connecting the respective first exerciser members together. A set of elastic members is connected between the opposite elastic-member-contactor lever arm portions. Mouth-contactor jackets cover free ends of the mouth-contactor lever arm portions.

The first exercising device provides a first extension distance between the mouth-contactor jackets when the first exercising device is in a relaxed condition.

The first pivot can be embodied as a recessed hexhead cap screw that is threaded through the respective fulcrum pivot channels of the first exerciser members and that is secured to the first exerciser members with lock nuts. A handle member is attached to the first pivot by screwing the handle member onto bottom thread portions of the screw.

A first case assembly can be provided for housing the first exercising device. The first case assembly includes a main first case portion for housing the non-mouth-contactor portions of the first exercising device, and an auxiliary first case portion, attachable to and removable from the main first case portion, is provided for covering the mouth-contactor jackets.

The first pivot can be embodied as follows. A double-end-threaded screw is threaded through a top side of the main first case portion, a top lock nut, the respective fulcrum pivot channels of the first exerciser members, a bottom lock nut, and a bottom side of the main first case portion. The lock nuts and the double-end-threaded screw secure the first exerciser members together. Screw knobs are screwed onto respective top and bottom threaded ends of the double-end-threaded screw.

With another embodiment of the invention, the horizontally oriented dynamic resistance means can be a form of a second exercising device which includes a pair of second exerciser members. Each of the second exerciser members includes a mouth-contactor lever arm portion, a mouth-contactor-lever-arm-positioned elastic-member-connector portion located on the mouth-contactor lever arm portion, and a fulcrum pivot channel adjacent to the mouth-contactor lever arm portion and positioned distal to the mouth-contactor-lever-arm-positioned elastic-member-connector portion. A distal lever arm portion is adjacent to the fulcrum pivot channel, and a distal-lever-arm-positioned elastic-member-connector portion is positioned at a distal portion of the distal lever arm portion.

The distal lever arm portions and the distal-lever-arm-positioned elastic-member-connector portions are positioned opposite each other, and the elastic-member-contactor lever arm portions extend substantially in an opposite direction to the mouth-contactor lever arm portions. A second pivot is received in the respective fulcrum pivot channels for connecting the respective second exerciser members together.

A pair of elastic members are provided. Each elastic member is connected between a mouth-contactor-lever-arm-positioned elastic-member-connector portion on one second exerciser member and a distal-lever-arm-positioned elastic-member-connector portion on another second exerciser member. Mouth-contactor jackets cover free ends of the mouth-contactor lever arm portions.

The second pivot can include a double-end-threaded screw that is threaded through, in sequence, a left side of the second case, a left lock nut, the respective fulcrum pivot channels of the second exerciser members, a right lock nut, and a right side of the second case. The second exerciser members are secured together with lock nuts on the double-end-threaded screw. Screw knobs are screwed onto respective right and left threaded ends of the double-end-threaded screw.

The second case can include a case base portion and a case lid portion which fits onto the case base portion. The case base portion can include a lid-reception step, and the case lid portion includes a base-reception step. The lid-reception step and the base-reception step are complementary and fit together.

The second exercising device provides a second extension distance between the mouth-contactor jackets when the second exercising device is in a relaxed condition. The second extension distance is smaller than the first extension distance. The second exercising device is smaller than the first exercising device.

The vertically oriented isometric resistance means can include a mouthpiece which includes a mouth-reception end and a weight-reception end. A weight-reception bracket includes a mouthpiece-connection end and a weight-support end, and weights are supported on the weight-reception bracket. The weight-reception end includes a resilient hook portion. A single vertically oriented isometric resistance means can be regarded as a unilateral isometric resistance exerciser.

Each of the mouthpieces of the unilateral isometric resistance exercisers includes a respective support-reception channel.

With another embodiment of the invention, a curved isometric resistance exerciser support member is threaded through the support-reception channels of plural unilateral isometric resistance exercisers, for supporting plural unilateral isometric resistance exercisers. Preferably, the curved isometric resistance exerciser support member is semicircular in shape. The curved isometric resistance exerciser support member includes marked pairs of unilateral-isometric-resistance-exerciser reception positions distributed symmetrically around a central axis of symmetry. By supporting plural unilateral isometric resistance exercisers symmetrically around the central axis of symmetry, a bilateral isometric resistance exerciser is provided.

In accordance with another aspect of the invention, there is provided herein a method of exercising facial muscles which includes the steps of having the facial muscles overcome dynamic resistance in a horizontal orientation, having the facial muscles overcome dynamic resistance in a vertical direction, and having the facial muscles encounter isometric resistance in a vertical direction. The facial muscles can be oriented in a horizontal orientation and in a vertical orientation.

Preferably, the facial muscles are stretched prior to contracting and overcoming dynamic resistance in a horizontal orientation. Also, preferably, the facial muscles are stretched prior to contracting and overcoming dynamic resistance in a vertical orientation.

The facial muscles can overcome dynamic resistance in a horizontal orientation in a range of dynamic resistances. The range of dynamic resistances can be created by selecting spring resistances to be overcome. Also, the facial muscles can overcome dynamic resistance in a vertical direction in a range of dynamic resistances, and the range of dynamic resistances can be created by selecting spring resistances to be overcome.

Also, the facial muscles can encounter isometric resistance in a vertical direction in a range of isometric resistances which can be created by selecting weight resistances to be encountered.

The first exercising device and the second exercising device are "dynamic" because they engage the facial muscles with a cyclical, alternating, stretching and contracting action. The isometric-unilateral exercisers and the isometric-bilateral exercisers are "isometric" because they engage the facial muscles statically, requiring that the muscles be held in a contracted state, without movement. The term "bilateral" refers to exercisers that engage the facial muscles on both sides of the face simultaneously. On the other hand, the term "unilateral" refers to exercisers that engage the facial muscles on only one side of the face.

When exercising the facial muscles with the facial muscle exercising apparatuses of the invention, for maximum effect, the teeth, the jaw, and the jaw muscles (masseters) are not to be involved in the exercise process. Only the orbicularis oris (lips) and attached, radiating facial muscles are to be targeted and engaged.

Although numerous variations of employing the exercisers of the invention exist, generally, the dynamic-bilateral exercisers are used to exercise the muscles of the mouth horizontally. Also, generally, the dynamic-unilateral exercisers are used to exercise the muscles of the mouth vertically. Generally, both the isometric-unilateral exercisers and the isometric-bilateral exercisers are used to exercise the muscles of the mouth vertically.

With the present invention, the facial muscles are stretched prior to contracting and overcoming dynamic resistance in a horizontal orientation. Also, the facial muscles are stretched prior to contracting and overcoming dynamic resistance in a vertical orientation. The prior stretching predisposes the muscles to producing a more intense subsequent contraction, thereby resulting in an optimum muscle action necessary for rapid growth and conditioning. Also, repetitive stretching and contracting of the facial muscles produces a beneficial vaso-constriction and vaso-dilation, resulting in a pump action, of blood vessels, which enhances circulation.

A wide variety of exercise protocols can be carried out using the facial muscle exercising apparatuses of the invention. For example, only three of the four types of facial muscle exercising apparatuses of the invention can be used with one exercise protocol (also called a "set"). That is, a dynamic-bilateral exerciser, and dynamic-unilateral exerciser, and one of the isometric exercisers can be employed in an exercise program. More specifically, a set of exercises can be done with the dynamic-bilateral exerciser, followed by a set of exercises with the dynamic-unilateral exerciser, followed by a set of exercises with the selected isometric exerciser. Sequential sets of exercises, such as thus described, can be referred to as an "exercise protocol". A user of the apparatuses can carry out a sequence of three exercise protocols without resting between the exercise protocols.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a number of preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is, therefore, an object of the present invention to provide a facial muscles exercising method and apparatus which permit increased muscle strength and mass due to the capability of the apparatus to provide the facial muscles with a controlled scale of graduated resistance increments.

Still another object of the present invention is to provide a facial muscles exercising method and apparatus that provide increased venous and lymphatic flow to the facial area thereby improving skin and muscle tissue tone.

Yet another object of the present invention is to provide a facial muscles exercising method and apparatus which permit carrying out a varied strengthening and conditioning program using horizontal and vertical dynamic and isometric contractions, as well as, spring and weight modes of resistance.

Even another object of the present invention is to provide a facial muscles exercising method and apparatus that facilitate a user to have a sense of personal accomplishment as the user is taking an active role in his or her facial muscle enhancement program, which is user measurable and trackable.

Still a further object of the present invention is to provide a facial muscles exercising method and apparatus which exercise facial muscles in a vertical direction.

Yet another object of the present invention is to provide a facial muscles exercising method and apparatus that provide for graduated increases in resistance to build muscle strength.

Still another object of the present invention is to provide a facial muscles exercising apparatus that provides muscle exercising arms which are connected directly together.

Yet another object of the present invention is to provide a facial muscles exercising apparatus that provides exercising arms that are connected directly together and in which the arms do not undergo translation motion as the facial muscles are being exercised.

Still a further object of the present invention is to provide a facial muscles exercising apparatus that provides two exercising arms which are connected together with a single pivot.

Yet another object of the present invention is to provide a facial muscles exercising apparatus which provides exercising arms that are securely fixed connected together, even in the absence of an elastic band.

Still a further object of the present invention is to provide a facial muscles exercising apparatus that is substantially contained in a housing, from which only mouth-engaingg members can stick out for engaging the mouth of a user.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is an enlarged side view of the first pivot of the embodiment of the invention shown in FIGS. 1 and 2.

FIG. 5 is an enlarged side view of the first pivot of the embodiment of the invention shown in FIG. 4.

FIG. 6 is an enlarged side view of a first pivot of a handle and case embodiment of the invention.

FIG. 11 is a side view of a unilateral isometric resistance exerciser of the invention.

FIG. 12 is a plan view of a bilateral isometric resistance exerciser of the invention.

DESCRIPTION OF THE PREFERRED EMBODIMENT

Figure 1:
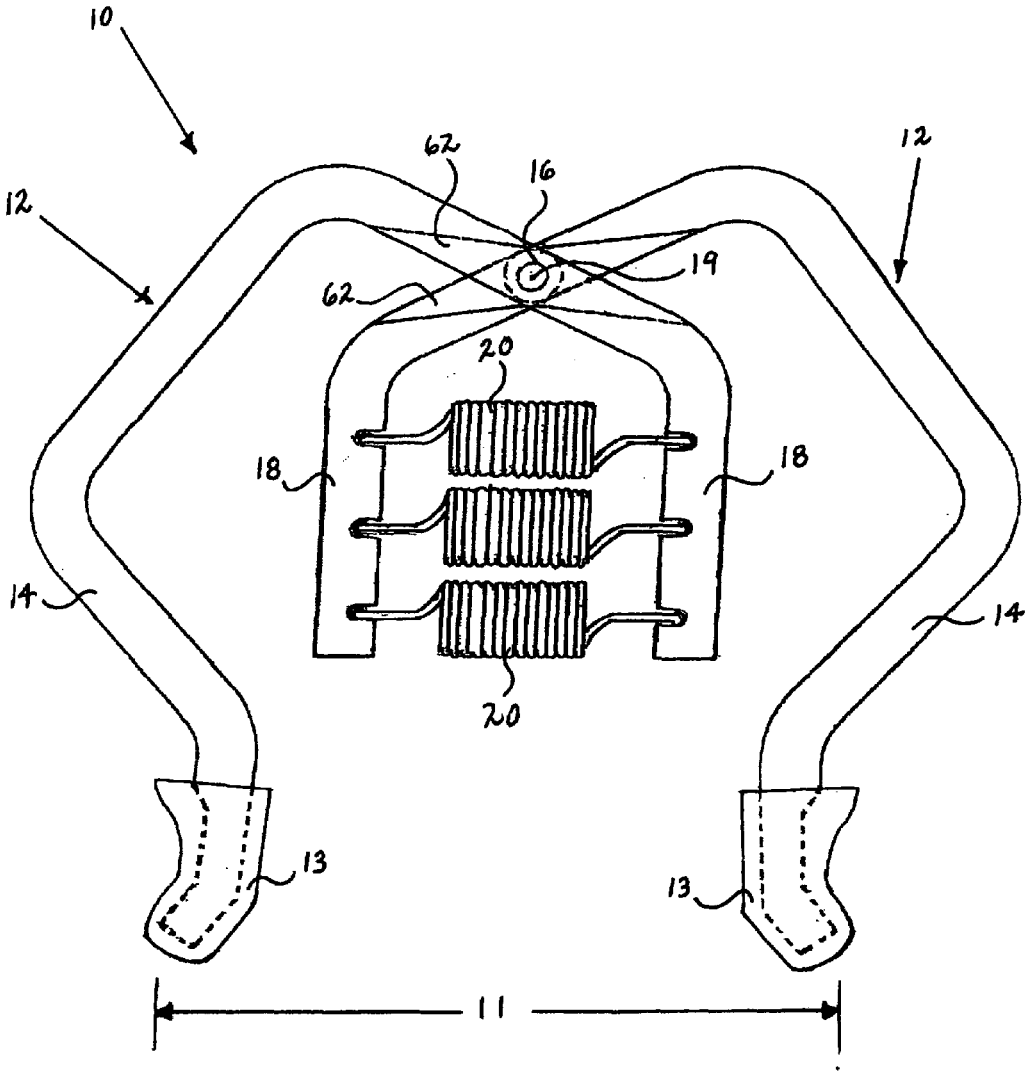
FIG. 1 is a plan view showing a handle only embodiment of a first exercising apparatus of the invention in an unstressed state.

With reference to the drawings, a facial muscles exercising method and apparatus embodying the principles and concepts of the present invention will be described.

A facial muscles exercising apparatus includes horizontally oriented dynamic resistance means for providing dynamic resistance to facial muscles that are exercised in a horizontal direction, vertically oriented dynamic resistance means for providing dynamic resistance to facial muscles that are exercised in a vertical direction, and vertically oriented isometric resistance means for providing isometric resistance to facial muscles that are exercised in a vertical direction. The vertically oriented isometric resistance means can be used with the facial muscles that are oriented in a horizontal orientation and that are oriented in a vertical orientation.

With one embodiment of the invention, the horizontally oriented dynamic resistance means are in a form of a first exercising device 10 which includes a pair of first exerciser members 12, each of which includes a mouth-contactor lever arm portion 14, a fulcrum pivot channel 16 adjacent to the mouth-contactor lever arm portion 14, and an elastic-member-contactor lever arm portion 18 adjacent to the fulcrum pivot channel 16. Elastic-member-contactor lever arm portions 18 of the pair of first exerciser members 12 are positioned opposite each other, and the elastic-member-contactor lever arm portions 18 extend substantially in the same direction as the mouth-contactor lever arm portions 14.

Figure 2:
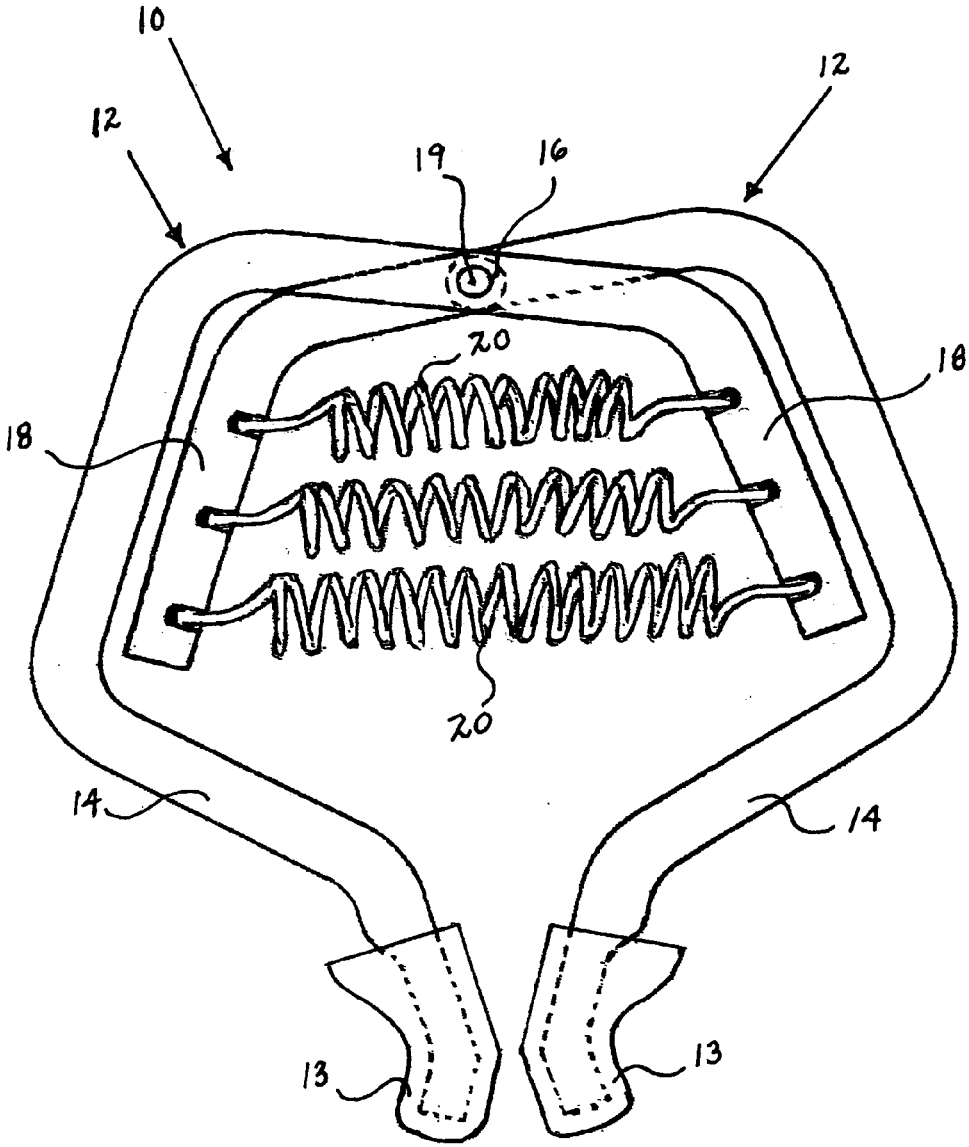
FIG. 2 is a plan view of the embodiment of the apparatus of the invention shown in FIG. 1 in a stressed state.

In addition, as is shown clearly in FIGS. 1 and 2, the elastic-member-contactor lever arm portions 18 are nested within the mouth-contactor lever arm portions 14.

A first pivot 19 is received in the respective fulcrum pivot channels 16 for connecting the respective first exerciser members 12 together. A set of elastic members 20 is connected between the opposite elastic-member-contactor lever arm portions 18. Mouth-contactor jackets 13 cover free ends of the mouth-contactor lever arm portions 14. The elastic members 20 can be springs 20 as shown in the drawings.

The first exercising device 10 provides a first extension distance 11 between the mouth-contactor jackets 13 when the first exercising device 10 is in a relaxed condition.

The first exercising device 10 is oriented horizontally, and the mouth-contactor jackets 13 are placed in the corners of a person's mouth with the first exercising device 10 in the relaxed condition shown in FIG. 1. To facilitate stretching of the facial muscles prior to each active contraction, the first extension distance 11 between the mouth-contactor jackets 13 is configured in both width and angle to provide a correct initial stretching of the facial muscles, prior to each subsequent contraction. Then, using facial muscles, to overcome the resistance provided by the elastic members 20, the person flexes the facial muscles against the mouth-contactor jackets 13 to move the first exercising device 10 to the stressed condition, shown in FIG. 2. As shown in FIG. 1, for each mouth-contactor lever arm portion 14 and for each elastic-member-contactor lever arm portion 18, respective portions thereof are provided with an internal notch portion 62. The internal notch portions 62 are milled out from the material in the first exerciser members 12. The respective internal notch portions 62 overlap and contact each other when the first pivot 19 is fully assembled. The respective internal notch portions 62 permit each lever arm portion from the first exerciser members 12 to lie in a common flat plane. In this respect, facial muscles are exercised in the common flat plane in which the mouth-contactor lever arm portions 14 lie. If the internal notch portions 62 were not present, the respective mouth-contactor lever arm portions 14 and the respective elastic-member-contactor lever arm portions 18 would not lie in a common plane, and the facial muscles that would be exercised would not lie in a common flat plane.

The first exercising device 10 can be made in three versions which include: a handle only version; a case only version; and a handle and case version.

With respect to the handle only version, reference is made to FIG. 3. The first pivot 19 is embodied as a recessed hexhead cap screw 28 that is threaded through the respective fulcrum pivot channels 16 of the first exerciser members 12 and that is secured to the first exerciser members 12 with lock nuts 30. Washers 34 are also employed as shown in FIG. 3. Handle member 32 is attached to the first pivot 19 by screwing the handle member 32 onto bottom thread portions of the screw 28.

When a user wants to use this handle only version of the first exercising device 10, the user simply grasps the handle member 32 and moves, carries, and positions the first exercising device 10 using the handle member 32. If desired, the handle member 32 can be unscrewed from the screw 28 for compact storage.

The elastic members 20, such as springs 20, can be provided in a wide variety of strengths to accommodate different levels of facial exercise progress. In this respect, the elastic members 20 can be of gradually increasing spring resistance whose utilization permits graduated increments in resistance encountered by facial muscles. Increases in muscle strength and mass can be effectively due to the capability of the apparatus to provide the facial muscles with a controlled scale of gradually increasing resistance increments.

Figure 4:
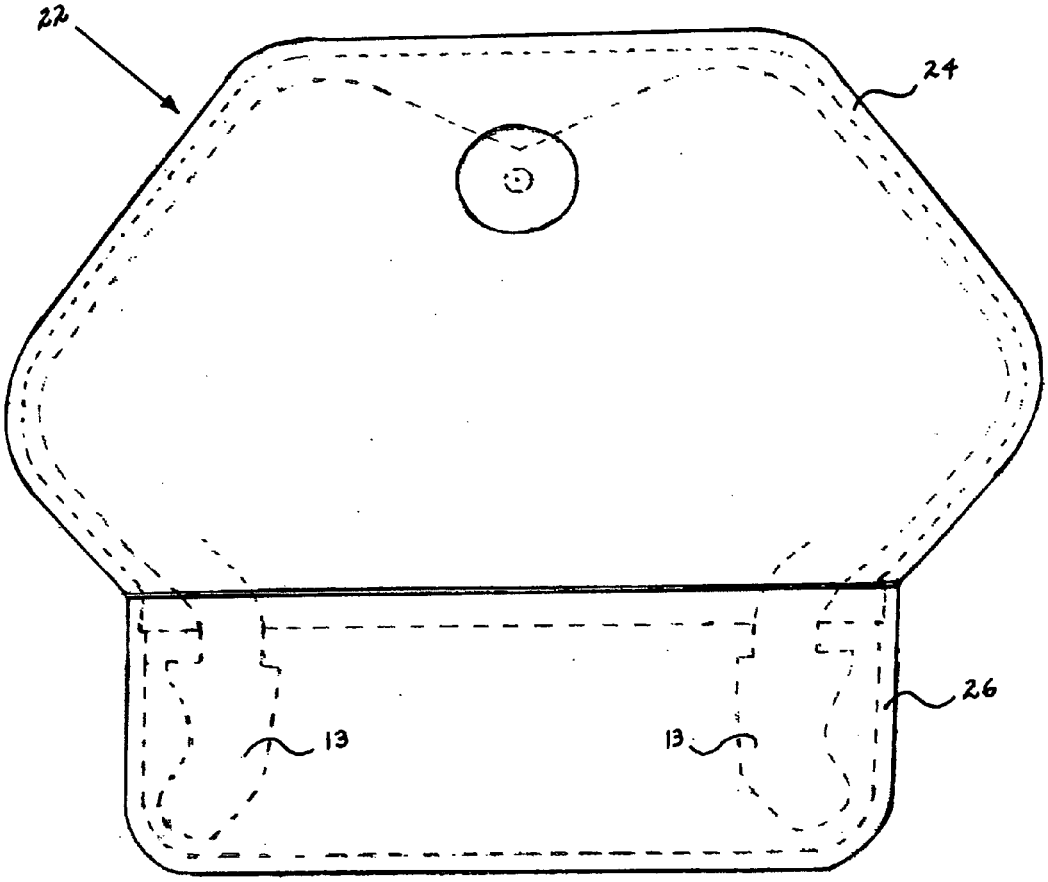
FIG. 4 is a plan view of a case only embodiment of a first exercising apparatus of the invention in an unstressed state.

With respect to the case only version of the first exercising device 10, with reference to FIG. 4, first case assembly 22 is provided for housing the first exercising device 10. The first case assembly 22 includes a main first case portion 24 for housing the non-mouth-contactor portions of the first exercising device 10, and an auxiliary first case portion 26, attachable to and removable from the main first case portion 24, is provided for covering the mouth-contactor jackets 13.

As shown in FIG. 5, the first pivot 19 can be embodied as follows. A double-end-threaded screw 36 is threaded through a top side 38 of the main first case portion 24, a top lock nut 30, the respective fulcrum pivot channels 16 of the first exerciser members 12, a bottom lock nut 30, and a bottom side 40 of the main first case portion 24. The lock nuts 30 secure the first exerciser members 12 together. Screw knobs 42 are screwed onto respective top and bottom threaded ends of the double-end-threaded screw 36. Washers 34 are also employed as shown in FIG. 5.

With respect to the handle and case version of the first exercising device 10, most elements are composed and operate in a manner similar to the case only version described above. However, with reference to FIG. 6 and the first pivot 19 shown therein, the bottom screw knob 42 has been removed from the bottom threaded portion 44 of the double-end-threaded screw 36, and a handle member 32 is screwed onto the bottom threaded portion 44 of the double-end-threaded screw 36.

Figure 7:
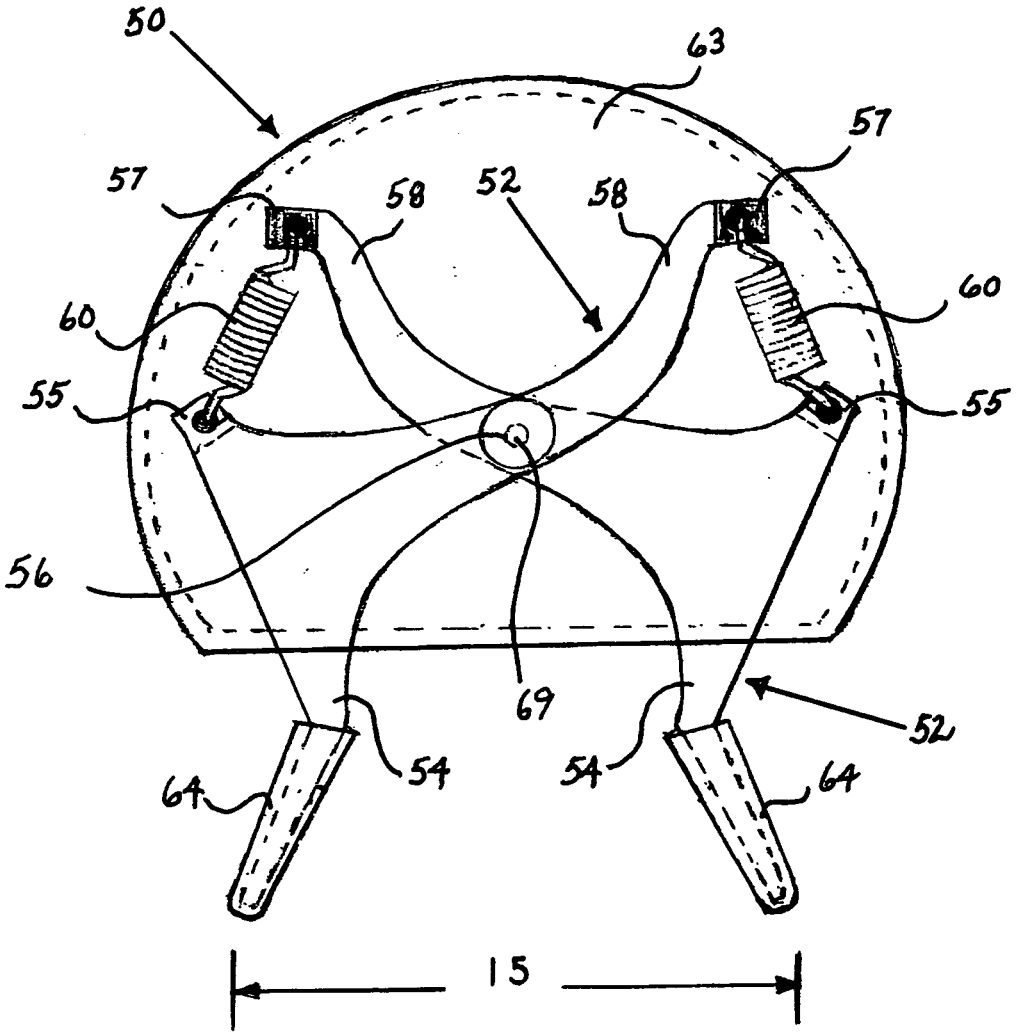
FIG. 7 is a plan view showing a case only embodiment of a second exercising apparatus of the invention in an unstressed state.
Figure 8:
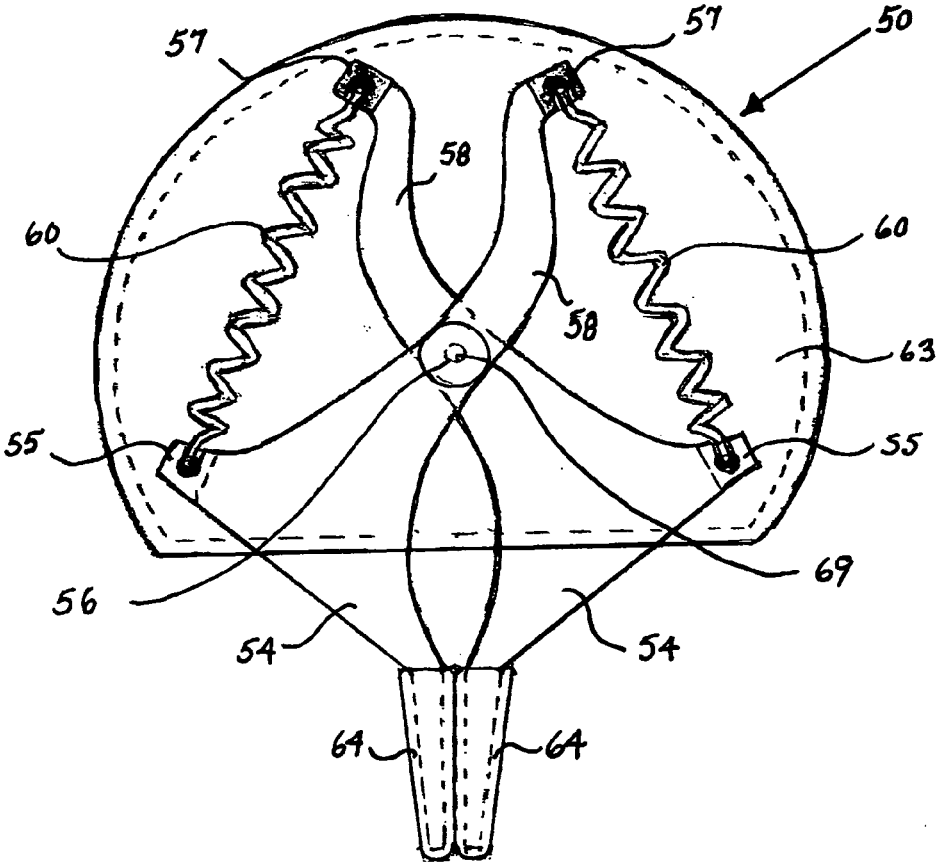
FIG. 8 is a plan view of the embodiment of the apparatus of the invention shown in FIG. 7 in a stressed state.

As shown in FIGS. 7 and 8, the horizontally oriented dynamic resistance means can be a form of a second exercising device 50 which includes a pair of second exerciser members 52. Each of the second exerciser members 52 includes a mouth-contactor lever arm portion 54, a mouth-contactor-lever-arm-positioned elastic-member-connector portion 55 located on the mouth-contactor lever arm portion 54, and a fulcrum pivot channel 56 adjacent to the mouth-contactor lever arm portion 54 and positioned distal to the mouth-contactor-lever-arm-positioned elastic-member-connector portion 55. A distal lever arm portion 58 is adjacent to the fulcrum pivot channel 56, and a distal-lever-arm-positioned elastic-member-connector portion 57 is positioned at a distal portion of the distal lever arm portion 58.

Figure 9:
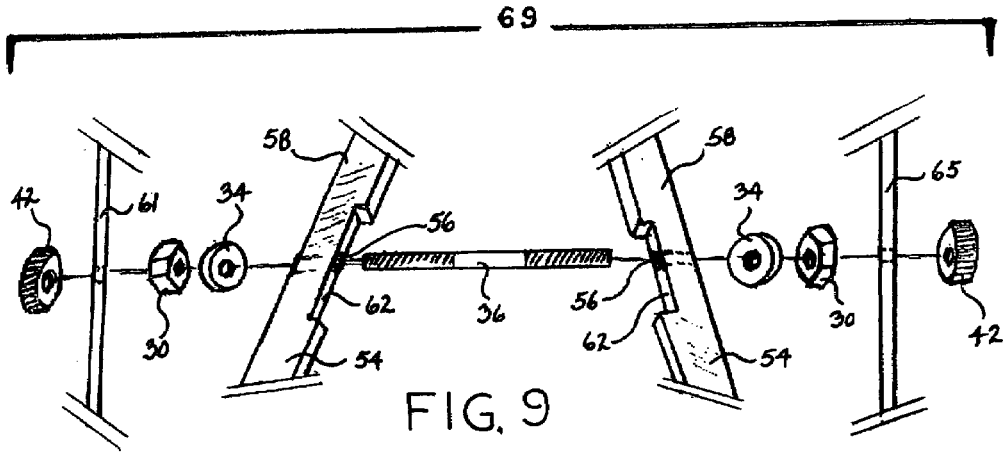
FIG. 9 is an enlarged, exploded, side view of a second pivot of the embodiment of the invention shown in FIGS. 7 and 8.

As shown in FIG. 9, for each mouth-contactor lever arm portion 54 and for each distal lever arm portion 58, respective portions thereof are provided with an internal notch portion 62. The respective internal notch portions 62 overlap and contact each other when the second pivot 69 is fully assembled. The respective internal notch portions 62 permit each lever arm portion from the second exerciser members 52 to lie in a common flat plane. In this respect, facial muscles are exercised in the common flat plane in which the second exerciser members 52 lie. If the internal notch portions 62 were not present, the respective mouth-contactor lever arm portions 54 and the respective distal lever arm portions 58 would not lie in a common plane, and the facial muscles that would be exercised would not lie in a common flat plane.

The distal lever arm portions 58 and the distal-lever-arm-positioned elastic-member-connector portions 57 are positioned opposite each other, and the elastic-member-contactor lever arm portions 58 extend substantially in an opposite direction to the mouth-contactor lever arm portions 54. A second pivot 69 is received in the respective fulcrum pivot channels 56 for connecting the respective second exerciser members 52 together.

A pair of elastic members 60 are provided. Each elastic member 60 is connected between a mouth-contactor-lever-arm-positioned elastic-member-connector portion 55 on one second exerciser member 52 and one distal-lever-arm-positioned elastic-member-connector portion 57 on another second exerciser member 52. Mouth-contactor jackets 64 cover free ends of the mouth-contactor lever arm portions 54.

To use the second exercising device 50, the second exercising device 50 is oriented vertically, and the mouth-contactor jackets 64 are placed in a person's mouth with the second exercising device 50 in the relaxed condition shown in FIG. 7. Then, using facial muscles, to overcome the resistance provided by the elastic members 60, the person flexes the facial muscles against the mouth-contactor jackets 64 to move the second exercising device 50 to the stressed condition, shown in FIG. 8.

As shown in FIG. 9, in an exploded view, the second pivot 69 is very similar to the first pivot 19 shown in FIG. 5. More specifically, The second pivot 69 includes a double-end-threaded screw 36 that is threaded through, in sequence, a left side 61 of the second case 63, a left lock nut 30, the respective fulcrum pivot channels 56 of the second exerciser members 52, a right lock nut 30, and a right side 65 of the second case 63. The second exerciser members 52 are secured together with lock nuts 30 on the double-end-threaded screw 36. Screw knobs 42 are screwed onto respective right and left threaded ends of the double-end-threaded screw 36. Washers 34 are also employed as shown in FIG. 9.

Figure 10:
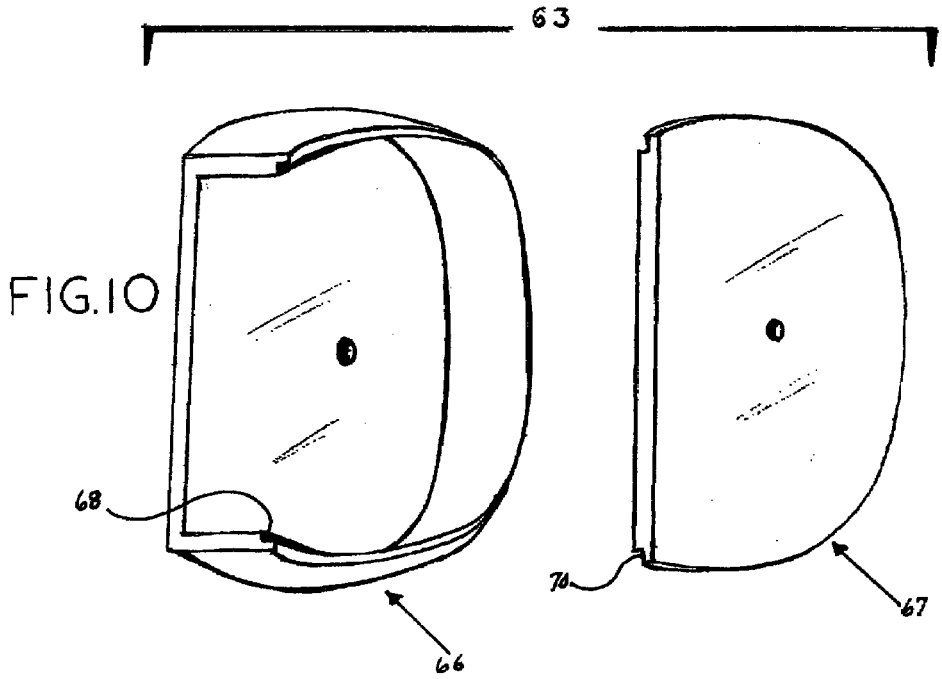
FIG. 10 is an exploded perspective view of the case of the embodiment of the invention shown in FIGS. 7, 8, and 9.

As shown in FIG. 10, the second case 63 can include a case base portion 66 and a case lid portion 67 which fits onto the case base portion 66. The case base portion 66 includes a lid-reception step 68, and the case lid portion 67 includes a base-reception step 70. The lid-reception step 68 and the base-reception step 70 are complementary and fit together.

The second exercising device 50 provides a second extension distance 15 between the mouth-contactor jackets 64 when the second exercising device 50 is in a relaxed condition. The second extension distance 15 is smaller than the first extension distance 11. The second exercising device 50 is smaller than the first exercising device 10. To faciliate stretching of the facial muscles prior to each active contraction, the second extension distance 15 between the mouth-contactor jackets 64 is configured in both width and angle to provide a correct initial stretching of the facial muscles, prior to each subsequent contraction.

Turning to FIG. 11, an embodiment of the vertically oriented isometric resistance means is shown. More specifically, FIG. 11 illustrates an embodiment of the vertically oriented isometric resistance means which is unilateral. That is, when used by a person, only one position at a time in the person's mouth is employed for experiencing isometric resistance. In this respect, the isometric resistance exerciser shown in FIG. 11 can be referred to as a unilateral isometric resistance exerciser 71.

As shown in the drawings, the vertically oriented isometric resistance means can include a mouthpiece 72 which includes a mouth-reception end 74 and a weight-reception end 76. A weight-reception bracket 78 includes a mouthpiece-connection end 80 and a weight-support end 82, and weights 84 are supported on the weight-reception bracket 78. The weight-reception end 76 includes a resilient hook portion. As shown in FIG. 11, the weight-support end 82 of the weight-reception bracket 78 is located directly vertically below the mouthpiece-connection end 80 of the weight-reception bracket 78.

To assemble the unilateral isometric resistance exerciser 71 shown in FIG. 11, a weight-reception bracket 78 is obtained. One or more weights 84, having bracket-reception channels, are threaded onto the mouthpiece-connection end 80 and down to the weight-support end 82 of the weight-reception bracket 78. The number of weights 84 and the respective weight values that are selected depend upon the status of the exercise program of the user. Early in an exercise program, fewer and lighter weights are employed. Later in an exercise program, more and heavier weights are employed.

Once the weights 84 have been installed on the weight-reception bracket 78, the mouthpiece-connection end 80 of the weight-reception bracket 78 is connected to the weight-reception end 76 of the mouthpiece 72. Once the mouthpiece 72 is connected to the weight-bearing weight-reception bracket 78, the mouth-reception end 74 of the mouthpiece 72 is ready for insertion into the user's mouth for exerting isometric resistance against mouth and facial muscles.

Turning to FIG. 12, another embodiment of the vertically oriented isometric resistance means is shown. More specifically, FIG. 12 illustrates an embodiment of the vertically oriented isometric resistance means in which isometric resistance is exerted on two different regions of mouth and facial muscles simultaneously. More specifically, two embodiments of the unilateral isometric resistance exerciser 71 that are shown in FIG. 11 are obtained. Each of the mouthpieces 72 of the unilateral isometric resistance exercisers 71 includes a respective support-reception channel 73.

A curved isometric resistance exerciser support member 75 is threaded through the support-reception channels 73 of plural unilateral isometric resistance exercisers 71, for supporting plural unilateral isometric resistance exercisers 71. Preferably, the curved isometric resistance exerciser support member 75 is semi-circular in shape. The curved isometric resistance exerciser support member 75 includes marked pairs of unilateral-isometric-resistance-exerciser reception positions distributed symmetrically around a central axis of symmetry 86. In this respect, the two unilateral isometric resistance exercisers 71 provide bilateral isometric resistance. Consequently, the embodiment of the invention shown in FIG. 12 is an embodiment that provides a bilateral isometric resistance exerciser 83.

For example, as shown in FIG. 12, a pair of marked first positions 77 on the curved isometric resistance exerciser support member 75 are shown near free ends of the curved isometric resistance exerciser support member 75 and are positioned symmetrically around the central axis of symmetry 86. A pair of marked second positions 79 on the curved isometric resistance exerciser support member 75 are shown at intermediate positions along the curved isometric resistance exerciser support member 75 and are positioned symmetrically around the central axis of symmetry 86. Also, a pair of marked third positions 81 are shown at near-central positions on the curved isometric resistance exerciser support member 75 and are positioned symmetrically around the central axis of symmetry 86. In FIG. 12, a pair of unilateral isometric resistance exercisers 71 are shown as being located on the pair of marked second positions 79 to provide the bilateral isometric resistance exerciser 83.

In accordance with another aspect of the present invention, a method of exercising facial muscles is provided which includes the steps of having the facial muscles overcome dynamic resistance in a horizontal orientation, having the facial muscles overcome dynamic resistance in a vertical direction, and having the facial muscles encounter isometric resistance in a vertical direction. The facial muscles can be oriented in a horizontal orientation and in a vertical orientation.

Preferably, the facial muscles are stretched prior to contracting and overcoming dynamic resistance in a horizontal orientation. Also, preferably, the facial muscles are stretched prior to contracting and overcoming dynamic resistance in a vertical orientation. The prior stretching predisposes the muscles to producing a more intense subsequent contraction, thereby resulting in an optimum muscle action necessary for rapid growth and conditioning. Also, repetitive stretching and contracting of the facial muscles produces a beneficial vaso-constriction and vaso-dilation, resulting in a pump action, of blood vessels, which enhances circulation.

The facial muscles can overcome dynamic resistance in a horizontal orientation in a range of dynamic resistances. The range of dynamic resistances can be created by selecting spring resistances to be overcome. Also, the facial muscles can overcome dynamic resistance in a vertical direction in a range of dynamic resistances, and the range of dynamic resistances can be created by selecting spring resistances to be overcome.

Most preferably, when using the facial muscle exercising apparatuses of the invention, the facial muscles are exercised using both dynamic, active contractions and isometric, static contractions. For example, dynamic, active contractions occur when the lips are alternately contracted and relaxed. Such dynamic, active contractions are preferably carried out in both a horizontal and vertical plane. Isometric, static contractions occur when the lips are contracted and are held contracted. Such isometric, static contractions are carried out in one or more vertical planes in one or more horizontal positions.

Also, the facial muscles can encounter isometric resistance in a vertical direction in a range of isometric resistances which can be created by selecting weight resistances to be encountered.

The facial muscle exercising apparatuses of the invention can be made from well know metal, such as space-age metals, and plastic materials, such as bio-compatible polymers, that are fitted in an attractive package which also can contain an elasticiser skin cream, a video tape presentation, and complete written instructions.

The facial muscle exercising apparatuses of the invention are preferably designed for single-user use for the following overall uses: medical, dental, and speech therapy; health and fitness; and cosmetic.

Medical uses can relate to rehabilitating patients who have facial muscle disabilities due to Bells Palsy, Ramsey-Hunt Syndrome, stroke, scleroderma, effects of head and neck surgery, pre- and post-operative plastic surgery, swallowing disorders, facial tics, and facial trauma due to accidents.

Dental uses can relate to aiding in anesthetic recovery, nerve trauma, paresthesia, temporo-mandibular-joint (TMJ) disorders, bite and jaw alignment, trismus, and bruxism.

Speech therapy uses can relate to motor nerve disorders of the facial muscles and lips.

The facial muscle exercising apparatuses of the invention can be used privately by the patient in the home, or they may be used in a programmed series of directed office or rehabilitation clinic visits.

Health and fitness uses can relate to providing means of directly exercising the facial muscles as part of a total physical exercise regimen. The facial muscle exercising apparatuses can also be used in health clubs, fitness centers, and spas or an individual, training/treatment basis or in a facial enhancement class.

Cosmetic uses can relate to using the facial muscle exercising apparatuses of the invention to substantially strengthen, firm, and tone the muscles and the skin of the facial area for a healthier and younger appearance. They can easily be used discreetly in the home.

The facial muscle exercising apparatuses of the invention, taken together and along with the methods of the invention, can be regarded as a facial muscle exercising system, known as "ORBEX"(TM). In this respect, the "ORBEX"(TM) facial exerciser system permits a user to become personally involved in the measurable and trackable progress of his or her own facial muscle recovery and development. It simultaneously generates exercise motivation, as well as, personal achievement satisfaction.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a facial muscles exercising method and apparatus which permit increased muscle strength and mass due to the capability of the apparatus to provide the facial muscles with a controlled scale of graduated resistance increments. With the invention, a facial muscles exercising method and apparatus provide increased venous and lymphatic flow to the facial area thereby improving skin and muscle tissue tone. With the invention, a facial muscles exercising method and apparatus are provided which permit carrying out a varied strengthening and conditioning program using horizontal and vertical dynamic and isometric contractions, as well as, spring and weight modes of resistance. With the invention, a facial muscles exercising method and apparatus are provided which facilitate a user to have a sense of personal accomplishment as the user takes an active role in his or her facial muscle enhancement program, which is user measurable and trackable. With the invention, a facial muscles exercising method and apparatus are provided which exercise facial muscles in a vertical direction. With the invention, a facial muscles exercising method and apparatus provide for graduated increases in resistance to build muscle strength.

With the invention, a facial muscles exercising apparatus provides muscle exercising arms which are connected directly together. With the invention, a facial muscles exercising apparatus provide exercising arms that are connected directly together and in which the arms do not undergo translation motion as the facial muscles are being exercised. With the invention, a facial muscles exercising apparatus provides two exercising arms which are connected together with a single pivot. With the invention, a facial muscles exercising apparatus provides exercising arms that are securely fixed connected together, even in the absence of an elastic band. With the invention, a facial muscles exercising apparatus is provided that is substantially contained in a housing, from which only mouth-engaging members can stick out for engaging the mouth of a user.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A facial muscles exercising apoaratus, comprising:

horizontally oriented dynamic resistance means for providing dynamic resistance to facial muscles being exercised in a horizontal direction, vertically oriented dynamic resistance means for providing dynamic resistance to facial muscles being exercised in a vertical direction, vertically oriented isometric resistance means for providing isometric resistance to facial muscles being exercised in a vertical direction, wherein said vertically oriented isometric resistance means can be used with the facial muscles that are oriented in a horizontal orientation and in a vertical orientation, wherein said horizontally oriented dynamic resistance means are in a form of a first exercising device which includes:

a pair of first exerciser members, each of which includes a mouth-contactor lever arm portion, a fulcrum pivot channel adjacent to said mouth-contactor lever arm portion, and an elastic-member-contactor lever arm portion adjacent to said fulcrum pivot channel, wherein elastic-member-contactor lever arm portions of said pair of first exerciser members are positioned opposite each other, and wherein said elastic-member-contactor lever arm portions extend substantially in the same direction as said mouth-contactor lever arm portions and are nested therein, a first pivot received in said respective fulcrum pivot channels for connecting said respective first exerciser members together, and a set of elastic members connected between said opposite elastic-member-contactor lever arm portions.

2. The apparatus of claim 1, further including:

mouth-contactor jackets covering free ends of said mouth-contactor lever arm portions.

3. The apparatus of claim 2, further including a first case assembly for housing said first exercising device, wherein said first case assembly includes:

a main first case portion for housing non-mouth-contactor portions of said first exercising device, and an auxiliary first case portion, attachable to and removable from said main first case portion, for covering said mouth-contactor jackets.

4. The apparatus of claim 3 wherein said first pivot is embodied as a double-end-threaded screw that is threaded through a top side of said main first case portion, a top lock nut, said respective fulcrum pivot channels of said first exerciser members, a bottom lock nut, and a bottom side of said main first case portion and that is secured to said first exerciser members with lock nuts, and including screw knobs screwed onto respective top and bottom threaded ends of said double-end-threaded screw.

5. The apparatus of claim 2 wherein said first exercising device provides a first extension distance between said mouth-contactor jackets when said first exercising device is in a relaxed condition.

6. The apparatus of claim 1 wherein said first pivot is embodied as a recessed hexhead cap screw that is threaded through said respective fulcrum pivot channels of said first exerciser members and that is secured to said first exerciser members with lock nuts.

7. The apparatus of claim 6, further including:

a handle member screwed onto bottom thread portions of said screw.

8. A facial muscles exercising apparatus, comprising:

horizontally oriented dynamic resistance means for providing dynamic resistance to facial muscles being exercised in a horizontal direction, vertically oriented dynamic resistance means for providing dynamic resistance to facial muscles being exercised in a vertical direction, vertically oriented isometric resistance means for providing isometric resistance to facial muscles being exercised in a vertical direction, wherein said vertically oriented isometric resistance means can be used with the facial muscles that are oriented in a horizontal orientation and in a vertical orientation, wherein said vertically oriented isometric resistance means include:

a mouthpiece which includes a mouth-reception end and a weight-reception end, a weight-reception bracket which includes a mouthpiece-connection end and a weight-support end, wherein said weight-support end of said weight-reception bracket is located directly vertically below said mouthpiece-connection end of said weight-reception bracket, and weights retained on said weight-reception bracket.

9. The apparatus of claim 8 wherein said weight-reception end includes a resilient hook portion.

10. The apparatus of claim 8, wherein said mouthpiece includes a support-reception channel and, further including:

a curved isometric resistance exerciser support member, threaded through respective support-reception channels of plural mouthpieces, for supporting plural vertically oriented isometric resistance means.

11. The apparatus of claim 10 wherein said curved isometric resistance exerciser support member is semi-circular in shape.

12. The apparatus of claim 10 wherein said curved isometric resistance exerciser support member includes marked pairs of unilateral-isometric-resistance-exerciser reception positions distributed symmetrically around a central axis of symmetry.

13. A facial muscles exercising apparatus, comprising:

dynamic resistance means for providing dynamic resistance to facial muscles being exercised, wherein said dynamic resistance means include a pair of first exerciser members, each of which includes a mouth-contactor lever arm portion, a fulcrum pivot channel adjacent to said mouth-contactor lever arm portion, and an elastic-member-contactor lever arm portion adjacent to said fulcrum pivot channel, a first pivot received in said respective fulcrum pivot channels for connecting said respective first exerciser members together, a set of elastic members connected between selected lever arm portions, a main case portion for substantially housing said pair of first exerciser members, leaving mouth-contacting portions of said mouth-contactor lever arm portions unhoused, and an auxiliary case portion, attachable to and removable from said main case portion, for covering said mouth-contactor lever arm portions.

* * * * *